US011311816B2

(12) United States Patent
Nelson et al.

(10) Patent No.: US 11,311,816 B2
(45) Date of Patent: Apr. 26, 2022

(54) BALLOON INFLATOR FOR SIMULTANEOUSLY FILLING TWO BALLOONS

(71) Applicant: Premium Balloon Accessories, Inc., Sharon Center, OH (US)

(72) Inventors: David C. Nelson, Akron, OH (US); Wesley A. Schroeder, Seville, OH (US); Tung Po Shao, Taipei (CN)

( * ) Notice: Subject to any disclaimer, the term of this patent is extended or adjusted under 35 U.S.C. 154(b) by 488 days.

(21) Appl. No.: 16/481,113

(22) PCT Filed: Jan. 30, 2017

(86) PCT No.: PCT/US2017/015569
§ 371 (c)(1),
(2) Date: Jul. 26, 2019

(87) PCT Pub. No.: WO2018/140051
PCT Pub. Date: Aug. 2, 2018

(65) Prior Publication Data
US 2021/0129037 A1 May 6, 2021

(51) Int. Cl.
*A63H 27/10* (2006.01)

(52) U.S. Cl.
CPC ..... *A63H 27/10* (2013.01); *A63H 2027/1033* (2013.01); *A63H 2027/1083* (2013.01)

(58) Field of Classification Search
CPC ..... A63H 27/10; A63H 2027/1033; A63H 2027/1083
See application file for complete search history.

(56) References Cited

U.S. PATENT DOCUMENTS

| | | | | |
|---|---|---|---|---|
| 4,974,393 | A | 12/1990 | Rich et al. | |
| 6,408,902 | B1 * | 6/2002 | Liau | A63H 27/10 141/105 |
| 6,488,557 | B1 * | 12/2002 | Elliott | A63H 27/10 446/220 |
| 8,641,387 | B2 * | 2/2014 | Wang | F04B 33/00 417/234 |

FOREIGN PATENT DOCUMENTS

| | | |
|---|---|---|
| GB | 2242138 | 9/1991 |
| WO | 2005085647 | 9/2005 |

OTHER PUBLICATIONS

Wikipedia—Diaphragm Pump; https://en.wikipedia.org/wiki/Diaphragm_pump; (2019).

* cited by examiner

*Primary Examiner* — Jason K Niesz
(74) *Attorney, Agent, or Firm* — Renner Kenner Greive Bobak Taylor & Weber

(57) ABSTRACT

A balloon inflator for simultaneously filling two balloons to substantially identical sizes includes an air pump having a first air chamber communicating with a first inflation nozzle and second air chamber communicating with a second inflation nozzle. A reciprocating piston causes an alternating increase and decrease in the first and second air chambers to advance air to fill balloons on the first and second inflation nozzles. The volume of inflation gas advanced to the first balloon inflation nozzle is substantially identical to the volume of inflation gas advanced to the second balloon inflation nozzle, thus permitting a virtually identical inflation of a first balloon at said first balloon inflation nozzle and a second balloon at said second balloon inflation nozzle upon repeated reciprocation of the piston.

9 Claims, 5 Drawing Sheets

BALLOON INFLATOR FOR SIMULTANEOUSLY FILLING TWO BALLOONS

FIELD OF THE INVENTION

The present invention generally relates to balloon inflation apparatus, herein balloon inflators. More particularly, the present invention relates to balloon inflators for simultaneously filling two balloons. In particular embodiments, this invention relates to balloon inflators for simultaneously filling two balloons to substantially identical sizes.

BACKGROUND OF THE INVENTION

Though there exist balloon inflators for simultaneously filling two balloons, they suffer from a number of disadvantages. Particularly, they cannot run continuously for very long because the motors employed overheat. Additionally, they employ solenoid valves that hold back the inflation gas until a particular pressure is reached, at which time the solenoid valve opens to allow the inflation gas to fill the balloon. Waiting for the pressure to increase to open the solenoid valve takes time, and is not desirable. Examples of such systems include Precision Air™ (Conwin Carbonic Co, USA) and B322 Fresh Air Balloon Inflator (Dongguan Boro Plastic Products Co., Ltd., China).

The prior art employs universal or series wound through flow motors that tend to overheat when employing those balloon inflators to fill large numbers of balloons. Once overheated, the balloon inflator must be allowed to rest before being again employed to fill balloons. Because balloon inflators for simultaneously filling two balloons are often employed for event planning, where hundreds, sometimes thousands, and sometimes tens of thousands of balloons are filled to decorate the event, the delays caused by overheating are costly. Filling such a large number of balloons requires a significant amount of man hours, and any time that a balloon inflator must remain off to cool down increases the amount of time it takes to fill the desired number of balloons. Thus, to efficiently fill the balloons, one must employ either accept the time delay in allowing balloon inflators to cool down (thus costing more in time and labor) or must employ more balloon inflators (at a higher capital expense), cycling to a cooler inflator when another inflator becomes too hot.

Additionally, the heat of the inflator can compromise the accurate sizing of the balloon. If the heat from operating the inflator affects the inflation gas, the balloon sizing might change. For example, if the inflation gas is heated by the heat generated by the balloon inflator, the balloon will be larger, as first, but will shrink after the inflation gas cools. The balloon inflators based on through flow motors are also loud and shrill, being uncomfortable, if not harmful to the ear.

Prior art inflators for filling two balloons to substantially the same size often suffer from a need to be recalibrated if the sizing of the two balloons is not accurate (i.e., one balloon is filled to a noticeably different volume. The calibration of these inflators is known to often fail after extended use. The calibration is not easy to adjust by a layman operator, and they often must be sent back to a manufacturer or other entity for recalibration. The present invention does not need recalibration.

In light of the foregoing, there is a need in the art for a balloon inflator for simultaneously filling two balloons to substantially identical sizes, wherein the balloon inflator does not overheat. There is further a need for such a balloon inflator that also operates at a decreased noise level.

SUMMARY OF THE INVENTION

In a first embodiment, the present invention provides a balloon inflator for simultaneously filling two balloons to substantially identical sizes comprising: an air pump including: a first air chamber having a volume defined in part by a position of a first movable member; a first balloon inflation nozzle; a first inflation passage from said first air chamber to said first balloon inflation nozzle; a second air chamber having a volume defined in part by a second movable member; a second balloon inflation nozzle; a second inflation passage from said second air chamber to said second balloon inflation nozzle, said second air chamber and said second inflation passage being separate and distinct from said first air chamber and said first inflation passage; a piston that, upon actuation of the balloon inflator, reciprocates between movement in a first direction and movement in a second direction, wherein (a) movement in said first direction moves said first movable member to reduce the volume of said first air chamber and advance inflation gas to said first balloon inflation nozzle while also moving said second movable member to increase the volume of said second air chamber and draw gas into said second air chamber, and (b) movement in a second direction moves said second movable member to reduce the volume of said second air chamber and advance inflation gas to said second balloon inflation nozzle while also moving said first movable member to increase the volume of said first air chamber and draw gas into said first air chamber, wherein the volume of inflation gas advanced to said first balloon inflation nozzle upon movement in said first direction is substantially identical to the volume of inflation gas advanced to said second balloon inflation nozzle upon movement in said second direction, thus permitting a virtually identical inflation of a first balloon at said first balloon inflation nozzle and a second balloon at said second balloon inflation nozzle upon repeated reciprocation of said piston.

In a second embodiment, this invention provides a balloon inflator as in any of the forgoing embodiments, further comprising a control system for setting a duration of time for reciprocation of said piston upon an actuation of the balloon inflator, the duration of time thus defining the volume of inflation gas advanced through both said first balloon inflation nozzle and said second balloon inflation nozzle upon actuation of the balloon inflator.

In a third embodiment, this invention provides a balloon inflator as in any of the forgoing embodiments, further including an actuator mechanism to actuate the balloon inflator.

In a fourth embodiment, this invention provides a balloon inflator as in any of the forgoing embodiments, wherein said actuator mechanism provides two modes of operation including (a) a time-based mode wherein the duration of time for reciprocation of said piston upon actuation is based upon a time setting in said control system, and (b) a continuous mode wherein the duration of time for reciprocation of said piston is based upon the duration of time the user of the balloon inflator actuates said actuator mechanism.

In a fifth embodiment, this invention provides a balloon inflator as in any of the forgoing embodiments, wherein the actuator mechanism is a foot switch having a cord, and the balloon inflator includes a first socket for said cord and a second socket for said cord, wherein plugging said cord into said first socket sets the balloon inflator to said time-based mode, and plugging said cord into said second socket sets the balloon inflator to said continuous mode.

In a sixth embodiment, this invention provides a balloon inflator as in any of the forgoing embodiments, further comprising a first inlet passage to said first air chamber and a second inlet passage to said second air chamber.

In a seventh embodiment, this invention provides a balloon inflator as in any of the forgoing embodiments, wherein said first inlet passage and said second inlet passage are separate and distinct.

In an eighth embodiment, this invention provides a balloon inflator as in any of the forgoing embodiments, wherein said first inlet passage and said second inlet passage share a common inlet.

In a ninth embodiment, this invention provides a balloon inflator as in any of the forgoing embodiments, wherein said reciprocating piston includes ferromagnetic material and reciprocation of said reciprocating piston is achieved by application of an alternating magnetic field.

DETAILED DESCRIPTION OF ILLUSTRATIVE EMBODIMENTS

Figure 1:
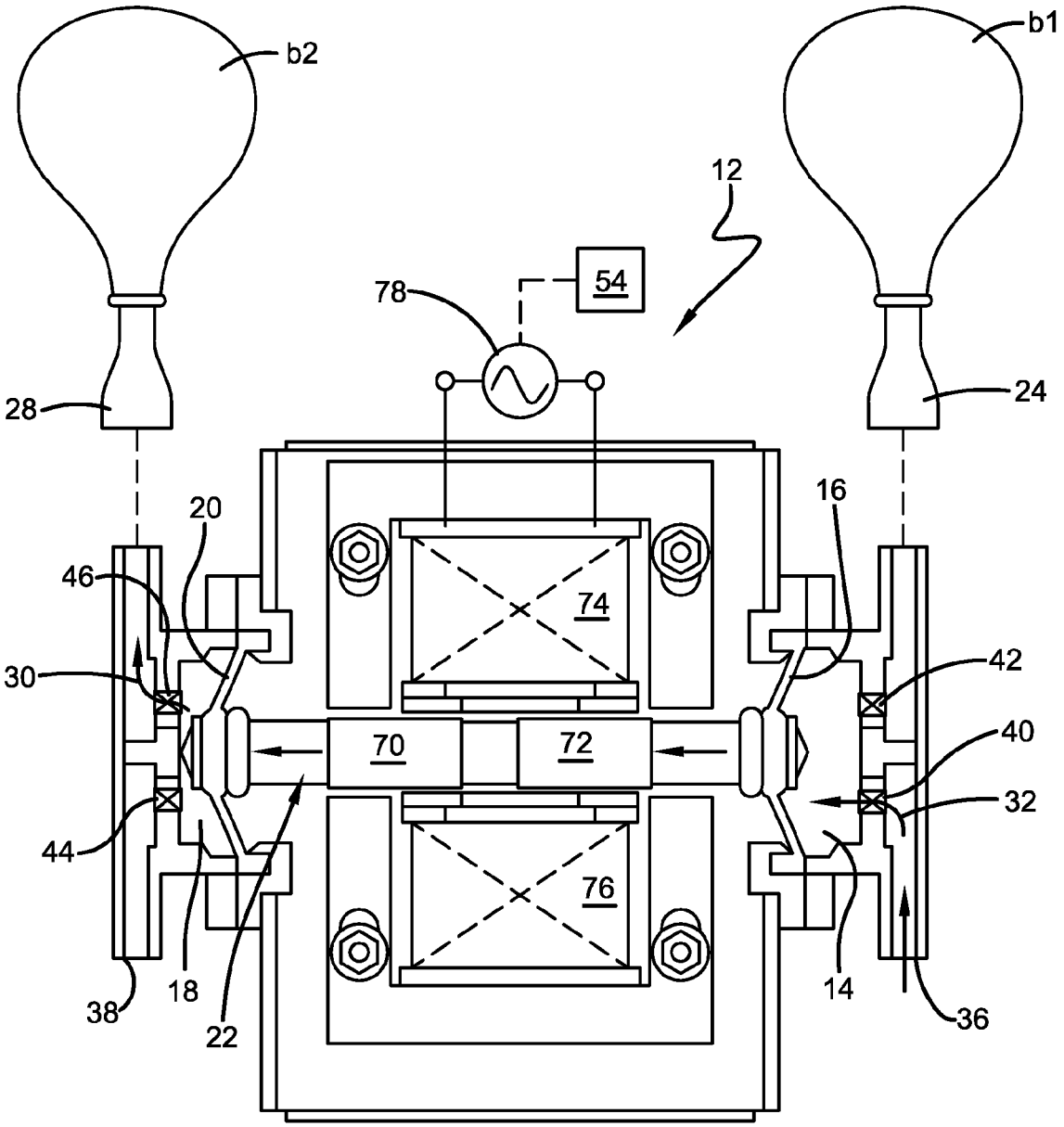
FIG. 1 is a schematic view of a balloon inflator in accordance with this invention shown with a first air chamber in an expanded or intake state and a second air chamber in a collapsed or exhaust state.
Figure 2:
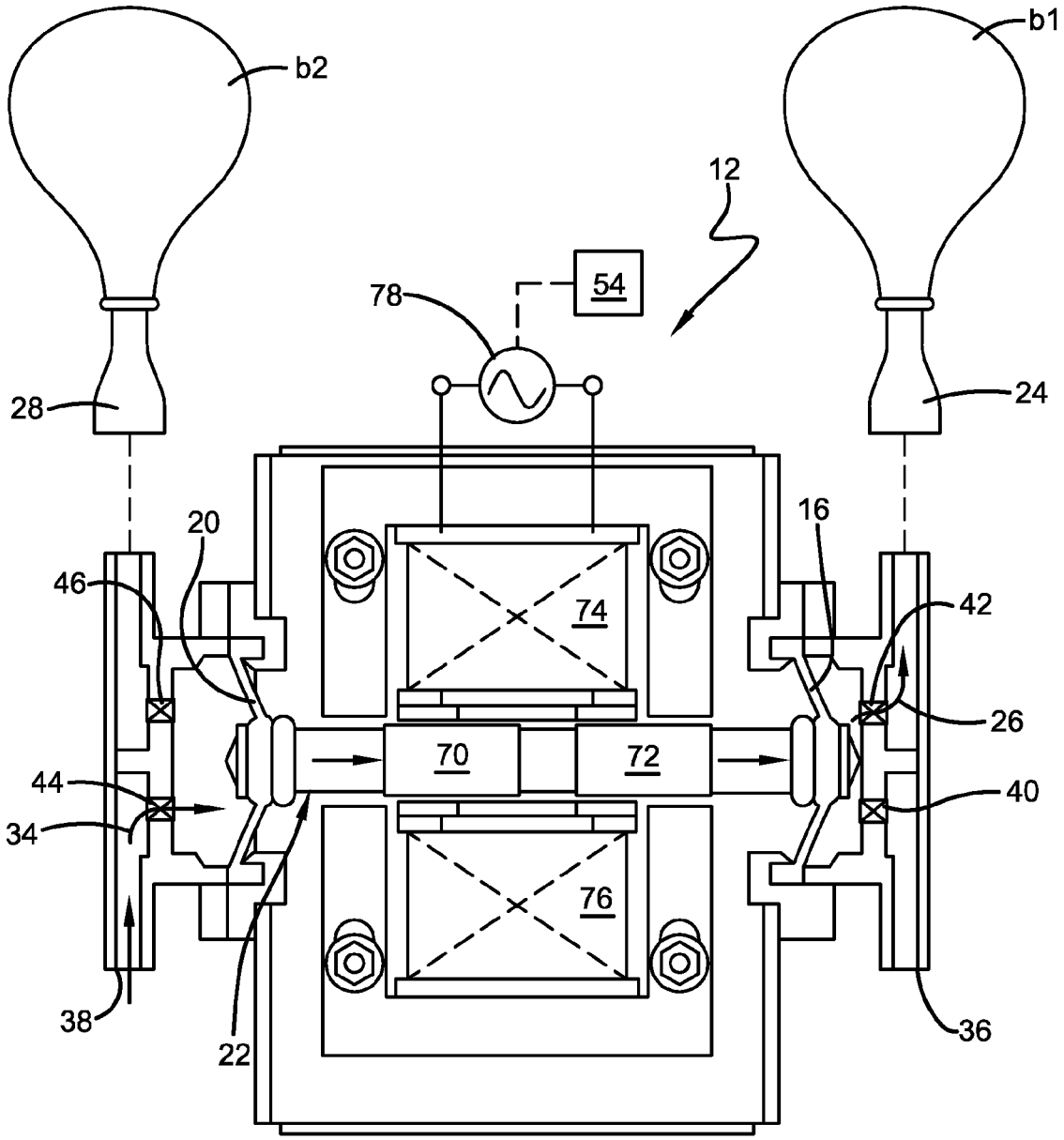
FIG. 2 is a schematic view of a balloon inflator in accordance with this invention shown with a second air chamber in an expanded or intake state and a first air chamber in a collapsed or exhaust state.
Figure 3:
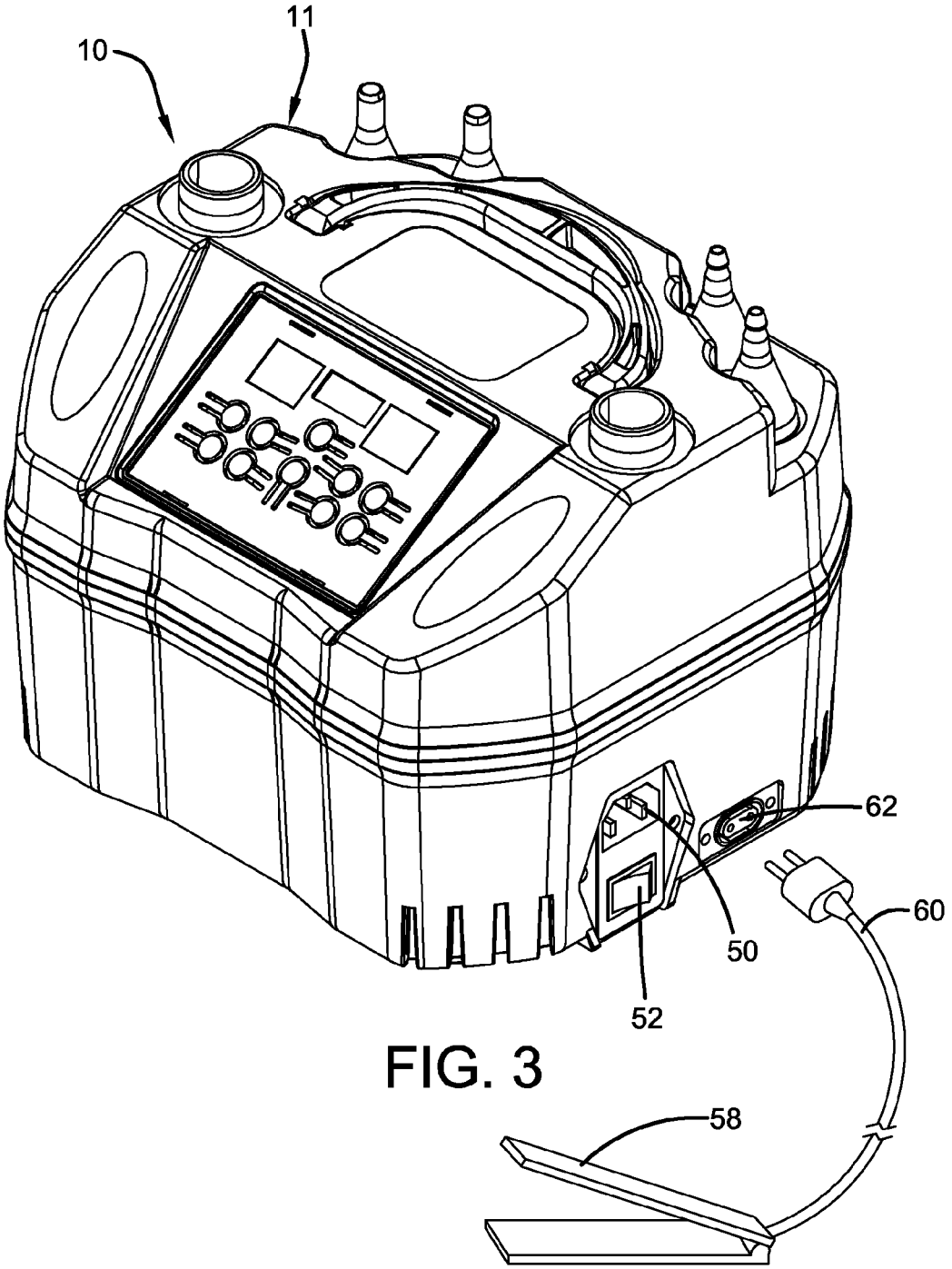
FIG. 3 is a perspective view of a possible housing configuration.
Figure 4:
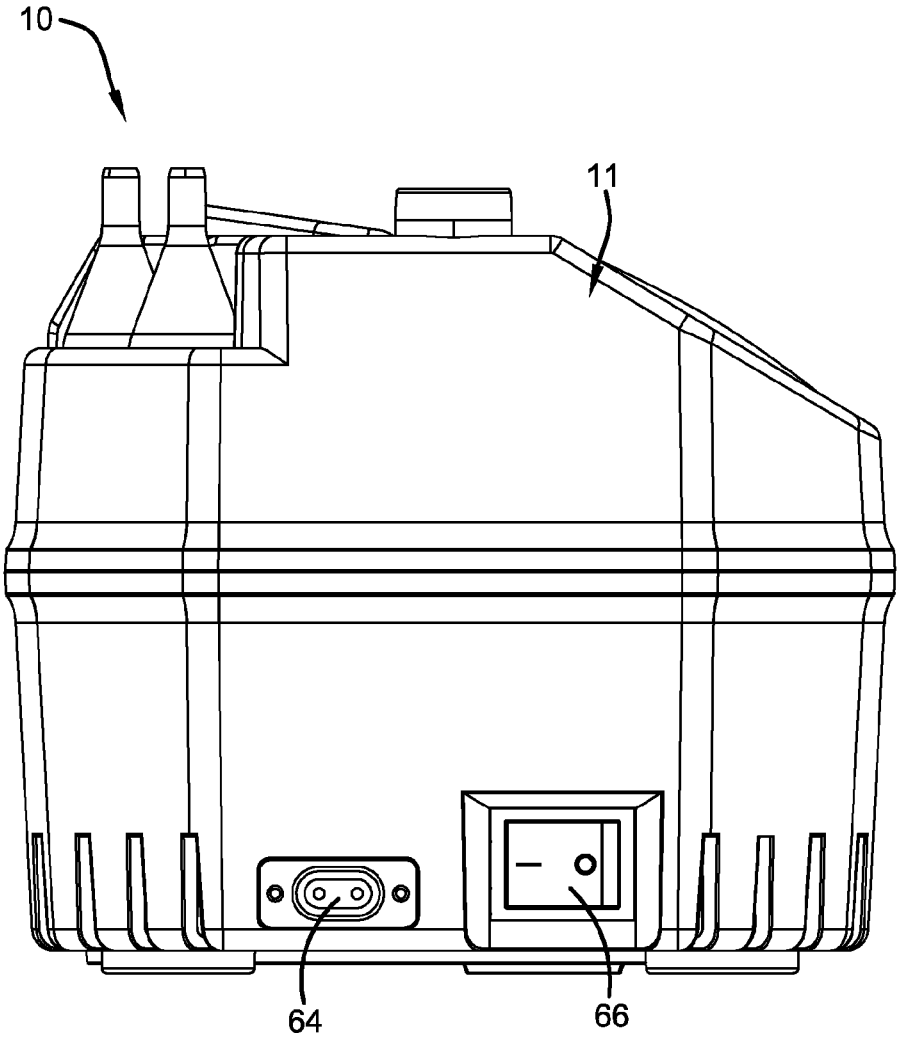
FIG. 4 is a right-side elevation view of the housing of FIG. 3.

Referring now to FIGS. 1 and 2, the basic structure and functioning of the balloon inflator of this invention is schematically shown and described. A particular embodiment of a balloon inflator in accordance with this invention is shown in FIGS. 3 and 4 and designated by the numeral 10, and it includes a particular housing 11 for an air pump 12. But the structure and functioning of balloon inflators of this invention is appreciated from the schematic representations in FIGS. 1 and 2. Therein, a balloon inflator of this invention includes an air pump 12 including a first air chamber 14 having a volume defined in part by a position of a first movable member 16, and a second air chamber 18 having a volume defined in part by a second movable member 20. The first movable member 16 and second movable member 20 are both operatively connected to a piston 22 capable of reciprocal motion between movement in a first direction (e.g., rightward in FIG. 1) and movement in a second direction (e.g., leftward in FIG. 2). The reciprocal movement of the piston results in the simultaneous filling of two balloons, as described below.

A first balloon inflation nozzle 24 receives air from a first inflation passage 26 (FIG. 2) extending from the first air chamber 14 to the first balloon inflation nozzle 24, and, similarly, a second balloon inflation nozzle 28 receives air from a second inflation passage 30 (FIG. 1) extending from the second air chamber 18 to the second balloon inflation nozzle 28. Notably, the second air chamber 18 and second balloon inflation passage 30 are separate and distinct from the first air chamber 14 and the first inflation passage 26. Upon actuation of the balloon inflator 10, the piston 22 reciprocates back and forth, as seen in a comparison of FIGS. 1 and 2, and this movement causes expansion and contraction of the volumes of first air chamber 14 and second air chamber 18, thus resulting in the advancement of gas to a first balloon b1 fitted to first balloon inflation nozzle 24 and a second balloon b2 fitted to the second balloon inflation nozzle 28.

More particularly, movement of the piston 22 in a first direction (here rightwardly from the position of FIG. 1 to the position of FIG. 2) causes the first movable member 16 to reduce the volume of the first air chamber 14 and advance inflation gas to the first balloon inflation nozzle 24, while also moving the second movable member 20 to increase the volume of the second air chamber 18 and draw gas into the second air chamber. Movement in a second direction (here leftwardly from the position of FIG. 2 to the position of FIG. 1) moves the second movable member 20 to reduce the volume of the second air chamber 18 and advance inflation gas to the second balloon inflation nozzle 28, while also moving the first movable member to increase the volume of the first air chamber 14 and draw gas into the first air chamber 14. The volume of inflation gas advanced to the first balloon inflation nozzle 24 upon movement in the first direction is substantially identical to the volume of inflation gas advanced to the second balloon inflation nozzle 28 upon movement in the second direction. This permits a virtually identical inflation of a first balloon b1 at the first balloon inflation nozzle 24 and a second balloon b2 at the second balloon inflation nozzle 28 upon repeated reciprocation of the piston 22. Theoretically, the two balloons could at most be off in size by the difference of one full stroke of the piston 22.

Figure 5:
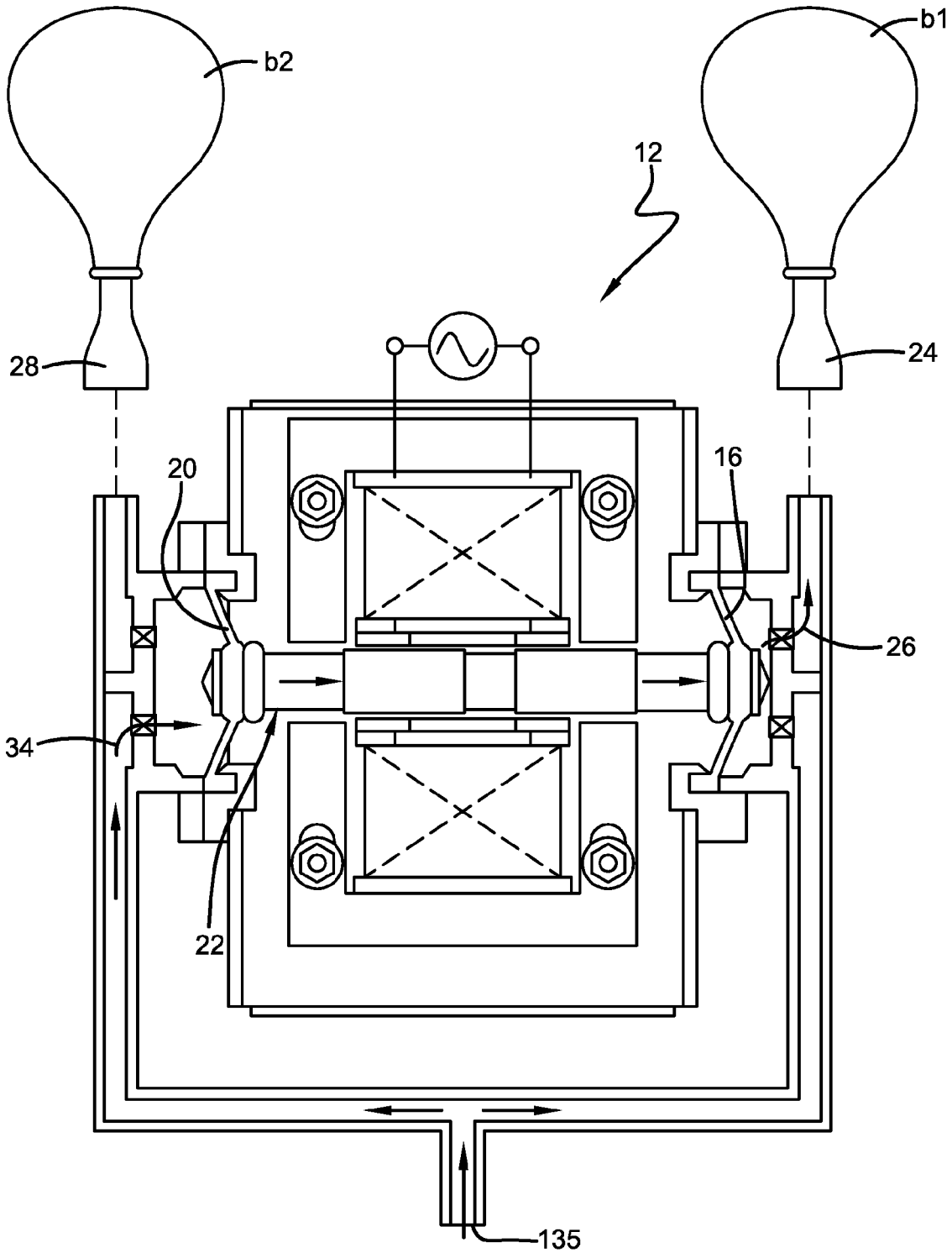

As already noted, the first and second inflation passages 26, 30 are separate passages. In some embodiments, inlet passages communicating with the first and second air chambers 14, 18 are also separate and distinct. For example, as seen in FIGS. 1 and 2, a first inlet passage 32 (FIG. 1) is defined from the ambient atmosphere to the first air chamber 14, and a second inlet passage 34 (FIG. 2) is defined from the atmosphere to the second air chamber 18. In the embodiment of FIGS. 1 and 2, the first inlet passage 32 has a first inlet 36 that is separate and distinct from the second inlet 38 of the second inlet passage 34; however, in some embodiments, the first and second inlet passages 32 and 34 can share a common inlet 135, as shown in FIG. 5.

In some embodiments, in order to ensure proper air flow, one-way valves are employed to regulate communication between the air chambers and their respective inlet passages and inflation passages. The one-way valves are seen in FIGS. 1 and 2. A first chamber inlet valve 40 regulates gas flow from the first inlet passage 32 into the first air chamber 14, and a first chamber outlet valve 42 regulates gas flow out of the first air chamber 14 to the first inflation passage 26. Similarly, a second chamber inlet valve 44 regulates gas flow from the second inlet passage 34 into the second air chamber 18, and a second chamber outlet valve 46 regulates gas flow out of the second air chamber 14 to the second inflation passage 30.

The balloon inflator 10 includes a power source, which can be any suitable power source, such as a battery or mains power supply, but is shown here intended to communicate with a mains power supply through a common power cord as represented by the empty socket at 50, in the illustrative embodiment of FIG. 3. A main on/off switch 52 can be used to control the incoming power supply and establish and "on" or "off" state for the balloon inflator 10.

In some embodiments, the balloon inflator 10 includes a control system, as represented at numeral 54, the control system 54 including appropriate hardware, software, circuitry etc, for controlling actuation of the balloon inflator 10. In some embodiments, the control system 54 is used to set a duration of time for reciprocation of the piston 22 upon an actuation of the balloon inflator. The duration of time will define the volume of inflation gas advanced through both the first balloon inflation nozzle 24 and the second balloon inflation nozzle 28 upon actuation of the balloon inflator 10. A keypad 56 (FIG. 3) can be provided to allow a user to set a duration of time. Actuation can be achieved through various actuator mechanisms.

Though any button or switch or other mechanisms can be used to actuate the reciprocation of the piston 22 and thus initiate the filling of two balloons, the embodiment shown beneficially employs a foot switch 58. The foot switch 58 is pressed by the user's foot to initiate filling of the balloons. In some embodiments, a duration of time for reciprocation of the piston 22 is set into the control system 54, and the foot switch 58 is pressed to initiate the reciprocation, which then proceeds for the set duration, and there is no need to hold the foot switch 58 down. In other embodiments, no duration of time is set (or no means for setting a duration of time is even provided), and the reciprocation of the piston 22 is initiated and maintain simply by the user holding the foot switch 58 down. The user thus controls the duration by the length of time the foot switch 58 is held in an "on" state.

More broadly, in some embodiments, the actuator mechanism provides two modes of operation including (a) a time-based mode wherein the duration of time for reciprocation of said piston upon actuation is based upon a time setting in said control system, and (b) a continuous mode wherein the duration of time for reciprocation of said piston is based upon the duration of time the user of the balloon inflator actuates said actuator mechanism.

In some embodiments, such as that shown in FIGS. 3 and 4, the user has the ability to switch how the foot pedal 58 is employed by switching the socket by which it interfaces with the remainder of the balloon inflator 10. Thus, in some embodiments, the actuator mechanism is a foot switch 58 having a cord 60, and the balloon inflator 10 includes both a first socket 62 (FIG. 3) and a second socket 64 (FIG. 4) for the cord 60, wherein plugging the cord 60 into the first socket 62 sets the balloon inflator to the time-based mode, and plugging the cord into the second socket 64 sets the balloon inflator to the continuous mode.

In some embodiments, the control system 60 includes a simple rocker switch 66 (FIG. 4) that actuates reciprocation of the piston 22 when in one position ("on" position) and stops reciprocation when in a second position ("off" position). In some embodiments, the control system 60 includes all the options seen in the drawings, including the foot switch 58 and the first and second sockets 62, 64, the rocker switch 66, and the keypad 56, all including a socket 50 for a mains power supply, and an on/off switch 52.

In some embodiments, the movable members 16, 20 are diaphragms operatively connected (e.g., as shown) to the distal ends of piston 22. However, other movable members and reciprocating pump mechanisms will be found to function similarly. For example, the distal ends of the piston could reciprocate in respective air chambers 14, 18 to decrease and increase the volumes thereof and thus move inflation gas.

In some embodiments, the piston 22 includes ferromagnetic material as at 70, 72, and the piston is positioned between electromagnets 74, 76 so as to reciprocate upon application of an alternating magnetic field as represented at 78. This type of pump, a duplex diaphragm pump, has been found to be capable of continuous use, without overheating, and while achieving pressures of from 45 inches of water and above. Additionally, this invention is devoid of means for calibration of inflation nozzles or other elements of the inflator.

The present pump allows for simultaneous inflation of two balloons to substantially the same size, wherein the sizing is not perceptible to the eye. Indeed, theoretically the two balloons could at most be off in size by the difference of one full stroke of the piston 22, and the term "substantially" is thus not at all unclear but rather reflects a reality well understood in the context of this disclosure. Indeed, the balloons could in fact be of identical size, and this will also qualify as "substantially" the same size in the context of this disclosure and the claims. The balloon inflator of this invention can run continuously, without overheating. It is relatively more quite than those inflators generally disclosed and specifically mentioned in the Background section. The present invention will provide party planners and the like with a new and much improved balloon sizing technology.

In light of the foregoing, it should be appreciated that the present invention significantly advances the art by providing a balloon inflator that is structurally and functionally improved in a number of ways. While particular embodiments of the invention have been disclosed in detail herein, it should be appreciated that the invention is not limited thereto or thereby inasmuch as variations on the invention herein will be readily appreciated by those of ordinary skill in the art. The scope of the invention shall be appreciated from the claims that follow.

What is claimed is:

1. A balloon inflator for simultaneously filling two balloons to substantially identical sizes comprising:

an air pump including:

a first air chamber having a volume defined in part by a position of a first movable member;

a first balloon inflation nozzle;

a first inflation passage from said first air chamber to said first balloon inflation nozzle;

a second air chamber having a volume defined in part by a second movable member;

a second balloon inflation nozzle;

a second inflation passage from said second air chamber to said second balloon inflation nozzle, said second air chamber and said second inflation passage being separate and distinct from said first air chamber and said first inflation passage;

a piston that, upon actuation of the balloon inflator, reciprocates between movement in a first direction and movement in a second direction, wherein (a) movement in said first direction moves said first movable member to reduce the volume of said first air chamber and advance inflation gas to said first balloon inflation nozzle while also moving said second movable member to increase the volume of said second air chamber and draw gas into said second air chamber, and (b) movement in a second direction moves said second movable member to reduce the volume of said second air chamber and advance inflation gas to said second balloon inflation nozzle while also moving said first movable member to increase the volume of said first air chamber and draw gas into said first air chamber, wherein the volume of inflation gas advanced to said first balloon inflation nozzle upon movement in said first direction is substantially identical to the volume of inflation gas advanced to said second balloon inflation nozzle upon movement in said second direction, thus permitting a virtually identical inflation of a first balloon at said first balloon inflation nozzle and a second balloon at said second balloon inflation nozzle upon repeated reciprocation of said piston.

2. The balloon inflator of claim 1, further comprising a control system for setting a duration of time for reciprocation of said piston upon an actuation of the balloon inflator, the duration of time thus defining the volume of inflation gas advanced through both said first balloon inflation nozzle and said second balloon inflation nozzle upon actuation of the balloon inflator.

3. The balloon inflator of claim 1, wherein said reciprocating piston includes ferromagnetic material and reciprocation of said reciprocating piston is achieved by application of an alternating magnetic field.

4. The balloon inflator of claim 1, further including an actuator mechanism to actuate the balloon inflator.

5. The balloon inflator of claim 4, wherein said actuator mechanism provides two modes of operation including (a) a time-based mode wherein the duration of time for reciprocation of said piston upon actuation is based upon a time setting in said control system, and (b) a continuous mode wherein the duration of time for reciprocation of said piston is based upon the duration of time the user of the balloon inflator actuates said actuator mechanism.

6. The balloon inflator of claim 4, wherein the actuator mechanism is a foot switch having a cord, and the balloon inflator includes a first socket for said cord and a second socket for said cord, wherein plugging said cord into said first socket sets the balloon inflator to said time-based mode, and plugging said cord into said second socket sets the balloon inflator to said continuous mode.

7. The balloon inflator of claim 1, further comprising a first inlet passage to said first air chamber and a second inlet passage to said second air chamber.

8. The balloon inflator of claim 6, wherein said first inlet passage and said second inlet passage are separate and distinct.

9. The balloon inflator of claim 7, wherein said first inlet passage and said second inlet passage share a common inlet.

* * * * *